US010480157B2

(12) United States Patent
Friend et al.

(10) Patent No.: US 10,480,157 B2
(45) Date of Patent: Nov. 19, 2019

(54) CONTROL SYSTEM FOR A MACHINE

(71) Applicant: Caterpillar Inc., Peoria, IL (US)

(72) Inventors: Paul Friend, Morton, IL (US); Kenneth L. Stratton, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 182 days.

(21) Appl. No.: 15/258,620

(22) Filed: Sep. 7, 2016

(65) Prior Publication Data

US 2018/0066415 A1 Mar. 8, 2018

(51) Int. Cl.

| | |
|---|---|
| ***E02F 9/20*** | (2006.01) |
| ***E02F 9/26*** | (2006.01) |
| *E02F 3/76* | (2006.01) |
| *E02F 3/30* | (2006.01) |

(52) U.S. Cl.

CPC ..... *E02F 9/2054* (2013.01); *E02F 9/205* (2013.01); *E02F 9/265* (2013.01); *E02F 3/308* (2013.01); *E02F 3/7604* (2013.01)

(58) Field of Classification Search

CPC ..... E02F 3/308; E02F 3/7604; E02F 9/205; E02F 9/2054; E02F 9/265

USPC ..... 701/50

See application file for complete search history.

(56) References Cited

U.S. PATENT DOCUMENTS 3,648,276 A * 3/1972 Schuman ..... G01B 3/006 341/2
5,908,458 A * 6/1999 Rowe ..... B25J 9/1658 701/50
6,223,110 B1 * 4/2001 Rowe ..... E02F 3/435 111/177
6,246,932 B1 * 6/2001 Kageyama ..... G05D 1/0297 340/992
6,292,725 B1 * 9/2001 Kageyama ..... G05D 1/027 180/169
6,363,632 B1 * 4/2002 Stentz ..... E02F 3/437 37/348
6,681,157 B2 * 1/2004 Kageyama ..... B60W 40/04 701/1

(Continued)

FOREIGN PATENT DOCUMENTS

| | | |
|---|---|---|
| JP | 5-114781 A | 5/1993 |
| WO | WO 2014/119711 A1 | 8/2014 |

*Primary Examiner* — Angelina Shudy

(74) *Attorney, Agent, or Firm* — Leydig, Voit & Mayer, Ltd.

(57) ABSTRACT

A system for controlling operation of a first material engaging work implement includes a first machine, a second machine, and a controller. The controller is configured to store a kinematic model and characteristics of the implement system, determine a second machine operation zone, with the second machine operation zone being defined by a material movement plan of the second machine, and determine a current pose of the first machine. The controller is further configured to determine a first machine operation zone based upon the pose of the first machine, the kinematic model and characteristics of the implement system, and the second machine operation zone, with the first machine operation zone being spaced from the second machine operation zone, and generate a plurality of command signals to move the first material engaging work implement within the first machine operation zone between a first position and a second position.

17 Claims, 8 Drawing Sheets

(56) References Cited

U.S. PATENT DOCUMENTS 6,711,838 B2 * 3/2004 Staub ..... E02F 9/26 172/2
7,793,442 B2 * 9/2010 Koch ..... E02F 9/2033 37/413
8,115,650 B2 * 2/2012 Dasilva ..... G08B 25/016 340/539.1
8,170,756 B2 5/2012 Morey et al.
8,346,512 B2 1/2013 McAree
8,364,353 B2 * 1/2013 Kiegerl ..... E02F 1/00 700/245
8,386,134 B2 2/2013 Morey et al.
8,477,021 B2 * 7/2013 Slack ..... G08G 1/163 340/435
8,639,416 B2 * 1/2014 Jones ..... A01B 69/007 342/357.22
8,648,709 B2 * 2/2014 Gauger ..... F16P 3/14 340/539.1
8,700,272 B2 * 4/2014 Stratton ..... E02F 3/84 172/103
8,768,579 B2 7/2014 Taylor et al.
8,768,583 B2 7/2014 Hargrave, Jr. et al.
8,868,113 B2 * 10/2014 Soulie ..... G08G 1/20 455/457
8,868,304 B2 * 10/2014 Bonefas ..... B65G 67/24 701/117
8,948,981 B2 * 2/2015 Wei ..... E02F 3/841 172/4.5
9,115,482 B2 8/2015 Hargrave, Jr. et al.
9,129,509 B2 * 9/2015 Rothacher ..... G01S 5/0072
9,134,721 B2 * 9/2015 Koehrsen ..... G05B 19/4061
9,256,227 B1 * 2/2016 Wei ..... G05B 15/02
9,542,824 B2 * 1/2017 Beggs ..... B60Q 1/2673
9,663,033 B2 * 5/2017 Bharwani ..... B60Q 9/008
9,797,247 B1 * 10/2017 Nelson ..... G05D 1/0044
9,858,819 B2 * 1/2018 Povey ..... G08G 1/0965
9,933,262 B2 * 4/2018 Vogel ..... G01C 21/165
10,017,919 B2 * 7/2018 Nomura ..... E02F 3/435
10,101,723 B2 * 10/2018 Wei ..... G05D 1/0217
10,146,220 B2 * 12/2018 McHugh ..... G06F 7/00
10,152,891 B2 * 12/2018 Rusciolelli ..... G08G 1/164
10,255,582 B2 * 4/2019 Shydo, Jr. ..... G05D 1/104
10,255,811 B2 * 4/2019 Naka ..... B60W 30/09
2001/0044697 A1 * 11/2001 Kageyama ..... B60W 40/04 701/301
2002/0165649 A1 * 11/2002 Wilhelm Rekow . A01B 69/008 701/26
2005/0040232 A1 * 2/2005 Maloney ..... G06K 7/0008 235/385
2006/0249321 A1 * 11/2006 Cook ..... E21C 35/24 180/168
2008/0189040 A1 * 8/2008 Nasu ..... G08G 1/163 701/301
2008/0234902 A1 * 9/2008 Johnson ..... E02F 3/422 701/50
2009/0043462 A1 * 2/2009 Stratton ..... E02F 9/2033 701/50
2009/0228177 A1 * 9/2009 Mintah ..... E02F 3/435 701/50
2010/0042257 A1 * 2/2010 Starr ..... G06F 3/0605 700/248
2010/0042940 A1 * 2/2010 Monday ..... G06F 3/0486 715/764
2010/0262342 A1 * 10/2010 Dix ..... A01B 69/008 701/50
2011/0106341 A1 * 5/2011 Kinoshita ..... G05D 1/0289 701/2
2011/0112730 A1 * 5/2011 Rekow ..... G05D 1/0219 701/50
2012/0053775 A1 * 3/2012 Nettleton ..... E21C 41/26 701/24
2012/0130582 A1 * 5/2012 Hukkeri ..... B60W 10/04 701/25
2012/0215379 A1 * 8/2012 Sprock ..... E02F 9/2054 701/2
2012/0215409 A1 * 8/2012 Wang ..... A01D 41/1278 701/50
2013/0006484 A1 * 1/2013 Avitzur ..... E02F 9/205 701/50
2013/0166156 A1 * 6/2013 Stanek ..... E02F 3/435 701/50
2014/0032058 A1 * 1/2014 Stratton ..... E02F 9/2045 701/50
2014/0278029 A1 * 9/2014 Tonguz ..... G08G 1/161 701/117
2014/0324291 A1 * 10/2014 Jones ..... A01B 69/007 701/41
2014/0336881 A1 * 11/2014 Clar ..... E02F 9/2045 701/50
2015/0361642 A1 * 12/2015 Stratton ..... G05D 1/0274 701/461
2015/0362922 A1 * 12/2015 Dollinger ..... A01B 69/008 701/2
2015/0376868 A1 * 12/2015 Jackson ..... E02F 9/2025 701/50
2016/0076224 A1 * 3/2016 Edara ..... E02F 9/2029 701/50
2016/0134995 A1 5/2016 McCoy et al.
2016/0153175 A1 * 6/2016 Wei ..... E02F 9/2025 701/50
2016/0231130 A1 * 8/2016 Akiyama ..... B60W 30/09
2017/0028914 A1 * 2/2017 Kiyokawa ..... B62D 15/028
2017/0073925 A1 * 3/2017 Friend ..... E02F 9/205
2017/0073935 A1 * 3/2017 Friend ..... E02F 9/265
2017/0277957 A1 * 9/2017 Tonoike ..... G06F 17/30259
2017/0280614 A1 * 10/2017 Turpin ..... A01B 79/005
2017/0286782 A1 * 10/2017 Pillai ..... B60W 40/08
2017/0292854 A1 * 10/2017 Zhang ..... G01C 21/3415
2017/0316692 A1 * 11/2017 Rusciolelli ..... G08G 1/164
2018/0024549 A1 * 1/2018 Hurd ..... H04W 4/021 701/2
2018/0359908 A1 * 12/2018 Kelley ..... A01B 69/008

* cited by examiner

CONTROL SYSTEM FOR A MACHINE

TECHNICAL FIELD

This disclosure relates generally to controlling a machine and, more particularly, to a control system for controlling movement of a first machine adjacent a second machine

BACKGROUND

Large machines for moving material such as a rope shovels, mining shovels, and excavators may move large amounts of material with each material movement cycle. During such material moving cycles, material may be dumped or displaced along undesired areas. Such undesired material may adversely affect the performance of the material movement cycles, either by impacting a loading, digging, or dumping operation, or by disrupting a desired route or path along which a machine may travel.

Accordingly, additional, smaller machines may operate in conjunction with the larger machines to move the undesired material in order to improve the efficiency of the larger material moving machines. Operation of the machines in close proximity to each other may present risks of collisions between the machines. In addition, because of the size of some of the machines, it may be difficult or impossible to quickly stop the machines to avoid collisions. Still further, visibility from within the machines, in particular large machines, may be limited thus further increasing the risk of collision.

Systems have been developed to generate avoidance zones around machines to reduce the likelihood of collisions. U.S. Pat. No. 8,768,583 discloses a rope shovel with a system for detecting objects in proximity to the rope shovel. Upon detecting an object, the system may augment control of the rope shovel to mitigate the impact of a possible collision. Alerts in the form of audible, visual or haptic feedback may be provided to the operator of the rope shovel The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for controlling operation of a first material engaging work implement includes a first machine, a second machine, and a controller. The first machine includes an implement system having a linkage assembly with the first material engaging work implement and a first machine pose sensor for generating first machine pose signals indicative of a pose of the first machine. The second machine includes a ground engaging drive mechanism to propel the second machine and a second material engaging work implement. The controller is configured to store a kinematic model and characteristics of the implement system of the first machine, determine a second machine operation zone, with the second machine operation zone being defined by a material movement plan of the second machine, and determine a current pose of the first machine based upon the first machine pose signals. The controller is further configured to determine a first machine operation zone based upon the current pose of the first machine, the kinematic model and characteristics of the implement system, and the second machine operation zone, with the first machine operation zone being spaced from the second machine operation zone, and generate a plurality of command signals to move the first material engaging work implement within the first machine operation zone between a first position and a second position.

In another aspect, a method of controlling operation of a first material engaging work implement includes providing a first machine including an implement system having a linkage assembly with the first material engaging work implement, providing a second machine including a ground engaging drive mechanism to propel the second machine and a second material engaging work implement, storing a kinematic model and characteristics of the implement system of the first machine, and determining a second machine operation zone, with the second machine operation zone being defined by a material movement plan of the second machine. The method further includes determining a current pose of the first machine based upon first machine pose signals generated by a first machine pose sensor, determining a first machine operation zone based upon the current pose of the first machine, the kinematic model and characteristics of the implement system, and the second machine operation zone, with the first machine operation zone being spaced from the second machine operation zone, and generating a plurality of command signals to move the first material engaging work implement within the first machine operation zone between a first position and a second position.

In still another aspect, a machine for use with a second machine includes an implement system, a machine pose sensor, and a controller. The second machine includes a ground engaging drive mechanism to propel the second machine and a second material engaging work implement, and a second machine operation zone is defined by a material movement plan of the second machine. The implement system of the machine has a linkage assembly including a material engaging work implement. The machine pose sensor operates to generate machine pose signals indicative of a pose of the machine. The controller is configured to store a kinematic model and characteristics of the implement system of the first machine, determine a current pose of the machine based upon the machine pose signals, determine a machine operation zone based upon the current pose of the machine, the kinematic model and characteristics of the implement system, and the second machine operation zone, with the machine operation zone being spaced from the second machine operation zone, and generate a plurality of command signals to move the material engaging work implement within the machine operation zone between a dig location and a dump location.

DETAILED DESCRIPTION

Figure 1:
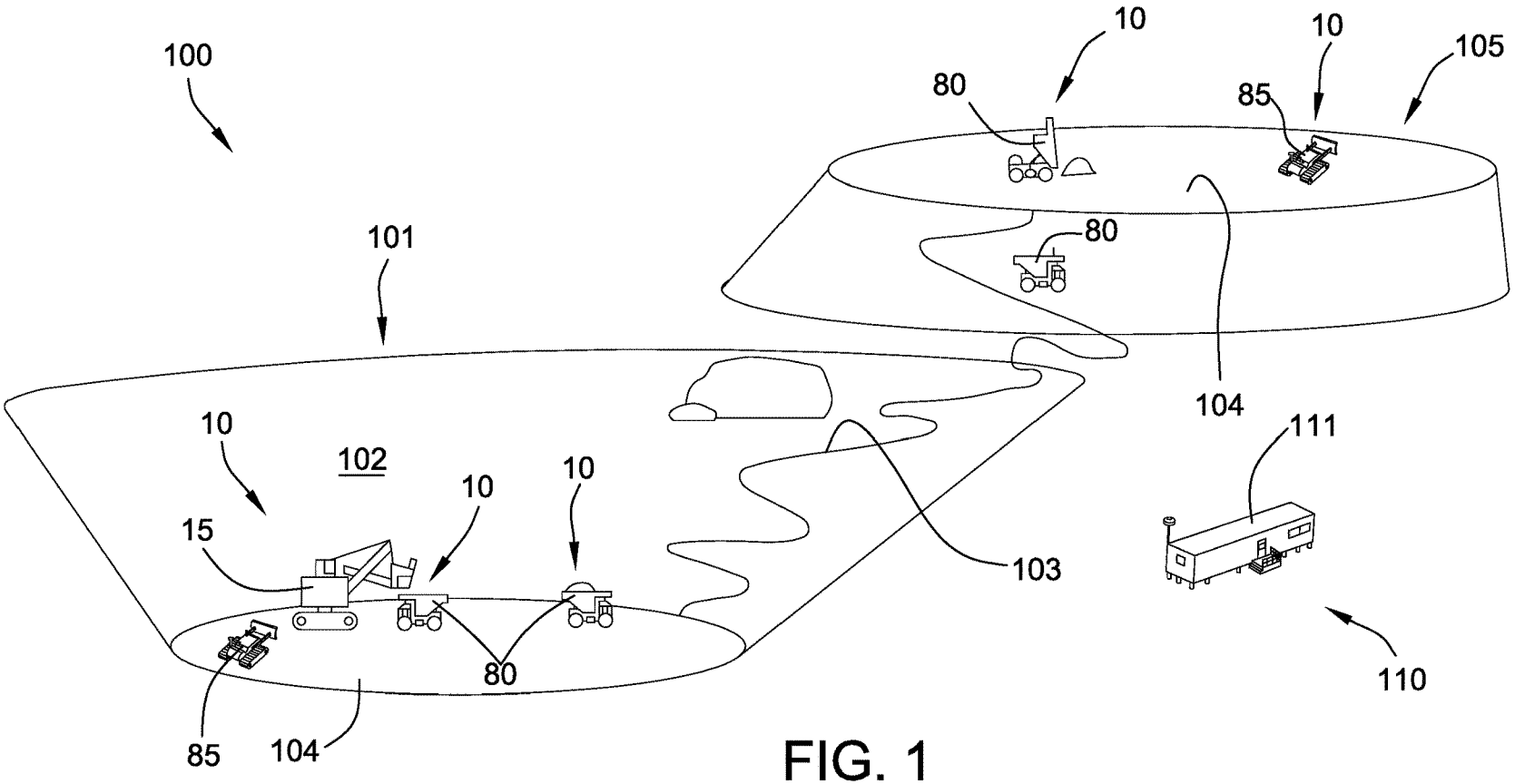
FIG. 1 depicts a schematic view of a work site at which machines incorporating the principles disclosed herein may be used.

FIG. 1 depicts a diagrammatic illustration of a work site 100 at which one or more machines 10 may operate. Work site 100 may be a portion of a mining site, a landfill, a quarry, a construction site, a roadwork site, a forest, a farm, or any other area in which movement of machines is desired. As depicted, work site 100 includes an open-cast or open pit mine 101 having a face 102 from which material may be excavated or removed by a machine 10 such as a rope shovel 15 and loaded into a machine such as a haul truck 80. The haul trucks 80 are depicted as traveling along a road 103 to dump location at which the material is dumped. Machines 10 such as dozers 85 may move material along a ground surface 104 near the rope shovel 15 as well as near or towards a crest such as an edge of a ridge 105, embankment, high wall or other change in elevation. Face 102 and ground surface 104 may be collectively referred to herein as a work surface.

Figure 2:
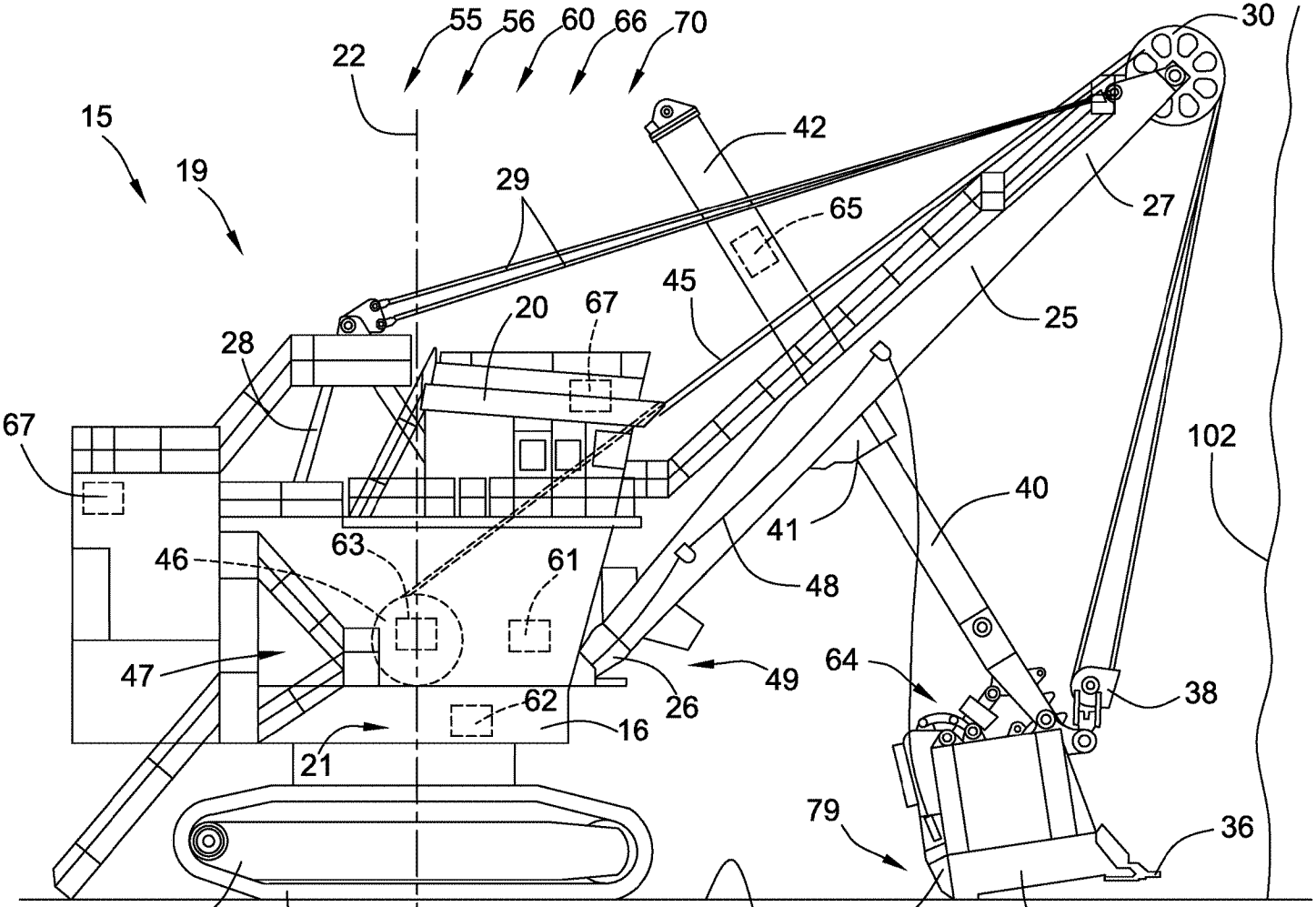
FIG. 2 depicts a diagrammatic illustration of a rope shovel in accordance with the disclosure.

Referring to FIG. 2, an exemplary rope shovel 15 is depicted. Rope shovel 15 includes a platform or base 16 rotatably mounted on an undercarriage or crawler 17. The crawler 17 may include a ground engaging drive mechanism such as a pair of tracks 18 that operate to propel and turn the rope shovel 15. Base 16 may include a power unit, indicated generally at 19 and an operator station 20. The power unit 19 provides or distributes electric and/or hydraulic power to various components of the rope shovel 15. A swing motor, indicated generally at 21, is operative to control the rotation of the base 16 relative to the crawler 17 about axis 22.

A linkage assembly or implement system may be mounted on the base 16 and includes a boom 25 having a lower or first end 26 operative connected, such as by being fixedly mounted, to the base 16. An A-frame 28 may be mounted on the based 16 and one or more support cables 29 may extend between the A-frame and an upper or second end 27 of the boom 25 to support the second end of the boom. A pair of spaced apart sheaves 30 may be mounted on the second end 27 of the boom 25.

The linkage assembly may further include a material engaging work implement such as a bucket or dipper 35 fixedly mounted to a connecting member or dipper handle 40. Dipper 35 may include a plurality of material engaging teeth 36 and a pivotable door 37 opposite the teeth to permit dumping or emptying of the dipper 35. At a first closed position, the door 37 retains material in the dipper 35, and at a second open position, material may exit the dipper through the door.

A hoist cable 45 extends from a hoist drum 46 on base 16, is supported by sheaves 30 on the second end 27 of boom 25, and engages a bail or padlock 38 associated with the dipper 35. Extension or retraction of the hoist cable 45 through rotation of a hoist motor, indicated generally at 47, lowers or raises the height (i.e., the hoist) of the dipper 35 relative to a ground reference. Material within the dipper 35 may be released by opening the door 37 of the dipper through the use of an actuator cable 48 that extends between the door and a door actuator motor 49 on the base 16.

Dipper handle 40 is generally elongated and is operatively connected to the boom 25. More specifically, the dipper handle 40 is slidably supported within saddle block 41 and the saddle block is pivotably mounted on the boom 25. Extension or retraction (also referred to as "crowd") of the dipper handle 40 may be controlled by a crowd control mechanism operatively connected to the dipper handle and the saddle block 41. In one embodiment, the crowd control mechanism may include a double acting hydraulic cylinder 42 with one side of the hydraulic cylinder operatively connected to the dipper handle 40 and the other side operatively connected to the saddle block 41. The crowd of the dipper handle 40 may thus be controlled by the operation of the hydraulic cylinder 42. In a second embodiment (not shown), a crowd rope and a retract rope may be operatively connected to the dipper handle and routed around a crowd drum. Rotation of the crowd drum controls the crowd of the dipper handle 40. In a third embodiment (not shown), a rack may be mounted on dipper handle and a drive pinion mounted on the saddle block. In the third embodiment, the crowd of the dipper handle 40 may be controlled by operation of the pinion.

Rope shovel 15 may include an operator station 20 that an operator may physically occupy and provide input to control the machine. The operator station 20 may include one or more input devices (not shown) that an operator may utilize to provide input to a control system, indicated generally at 55, to control aspects of the operation of the rope shovel 15. The operator station 20 may also include a plurality of display devices (not shown) to provide information to an operator regarding the status of the rope shovel 15 and material moving operations.

Control system 55 may include an electronic control module or controller 56 and a plurality of sensors. The controller 56 may receive input signals from an operator operating the rope shovel 15 from within operator station 20 or off-board the machine through a wireless communications system 110 (FIG. 1). The controller 56 may control the operation of various aspects of the rope shovel 15 including positioning the dipper 35 and opening the door 37 of the dipper to dump a load of material.

The controller 56 may be an electronic controller that operates in a logical fashion to perform operations, execute control algorithms, store and retrieve data and other desired operations. The controller 56 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 56 such as power supply circuitry, signal conditioning circuitry, driver circuitry, and other types of circuitry.

The controller 56 may be a single controller or may include more than one controller disposed to control various functions and/or features of the rope shovel 15. The term "controller" is meant to be used in its broadest sense to include one or more controllers and/or microprocessors that may be associated with the rope shovel 15 and that may cooperate in controlling various functions and operations of the machine. The functionality of the controller 56 may be implemented in hardware and/or software without regard to the functionality. The controller 56 may rely on one or more data maps relating to the operating conditions and the operating environment of the rope shovel 15 and the work site 100 that may be stored in the memory of or associated with the controller. Each of these data maps may include a collection of data in the form of tables, graphs, and/or equations.

The control system 55 and the controller 56 may be located on the rope shovel 15 as an on-board control system with an on-board controller or may be distributed with components such as an off-board controller also located remotely from or off-board the rope shovel such as at command center 111 (FIG. 1) and/or on another machine such as dozer 85. The functionality of control system 55 may be distributed so that certain functions are performed at rope shovel 15 and other functions are performed remotely. In such case, the control system 55 may utilize a communications system such as wireless communications system 110 for transmitting signals between the rope shovel 15 and a system located remote from the machine.

Rope shovel 15 may be equipped or associated with a plurality of sensors that provide data indicative (directly or indirectly) of various operating parameters of the machine. The term "sensor" is meant to be used in its broadest sense to include one or more sensors and related components that may be associated with the rope shovel 15 and that may cooperate to sense various functions, operations, and operating characteristics of the machine.

A pose sensing system 60, as shown generally by an arrow in FIG. 2, may include a pose sensor 61 to sense the position and orientation (i.e., the heading, pitch, roll or tilt, and yaw) of the rope shovel 15 relative to the work site 100. The position and orientation of the rope shovel 15 are sometimes collectively referred to as the pose of the machine.

The pose sensor 61 may include a plurality of individual sensors that cooperate to generate and provide pose signals to controller 56 indicative of the position and orientation of the rope shovel 15. In one example, the pose sensor 61 may include one or more sensors that interact with a positioning system such as a global navigation satellite system or a global positioning system to operate as a pose sensor. In another example, the pose sensor 61 may further include a slope or inclination sensor such as pitch angle sensor for measuring the slope or inclination of the rope shovel 15 relative to a ground or earth reference. The controller 56 may use pose signals from the pose sensors 61 to determine the pose of the rope shovel 15 within work site 100. In other examples, the pose sensor 61 may take other forms such as those used with a perception based system, or may use other systems such as lasers, sonar, cameras, ranging radios, or radar to determine all or some aspects of the pose of rope shovel 15.

If desired, the pose sensing system 60 may include distinct position and orientation sensing systems. In other words, a position sensing system (not shown) may be provided for determining the position of the rope shovel 15 and a separate orientation sensing system (not shown) may be provided for determining the orientation of the machine.

One or more implement sensors may be provided to monitor the position and status of the dipper 35. More specifically, sensors may be provided to provide signals indicative of the position and other characteristics of the dipper 35. A swing sensor 62 may be provided that generates swing signals indicative of the angle of the base 16 relative to the crawler 17. In one example, the pose sensing system 60 may determine the pose of the base 16 and the swing sensor 62 may determine the angle of the crawler 17 relative to the base.

A hoist sensor 63 may be provided that generates hoist signals indicative of the height of the dipper 35 relative to the base 16. The hoist signals may be based upon the position of the hoist cable 45, the hoist drum 46, and/or the hoist motor 47. A door sensor 64 may be provided that generates door signals indicative of the status (i.e., open or closed) of the door 37 of the dipper 35. A crowd sensor 65 may be associated with the boom 25, dipper handle 40, and/or saddle block 41. The crowd sensor 65 may be configured to generate crowd signals indicative of the crowd or position (i.e., the extension or retraction) of the dipper handle 40 relative to the boom 25.

Each of the sensors may embody any desired structure or mechanism. While described in the context of position sensors that may be used to determine the relative positions of the base 16, crawler 17, dipper 35, and dipper handle 40, some or all of the sensors may use another frame of reference such as a global navigation satellite system or a global positioning system. For example, one or more sensors may be similar to the pose sensor 61 and determine positions relative to an earth or another non-machine based reference.

The positions of the components of the rope shovel 15 including base 16, boom 25, dipper 35 and dipper handle 40 may be determined based upon the kinematic model of the rope shovel together with the dimensions of the base 16, crawler 17, dipper 35, and dipper handle 40, as well as the relative positions between the various components. More specifically, the controller 56 may include or store a data map that identifies the position of each component of the rope shovel 15 based upon the relative positions between the various components. The controller 56 may use the dimensions and the positions of the various components to generate and store a three-dimensional electronic map of the rope shovel 15 at the work site 100. In addition, by knowing the speed or acceleration of certain components, the speed or acceleration of other components of the rope shovel 15 may be determined.

The control system 55 may also include a terrain mapping or perception system 66 positioned on or associated with rope shovel 15 to scan work site 100 and map the work surface surrounding the rope shovel as well as any obstacles at the work site. The perception system 66 may include one or more perception sensors 67 that may scan work site 100 to gather information defining the work surface thereof. More specifically, perception sensors 67 may determine the distance and direction from the perception sensors 67 to points that define a mapped surface such as the work surface as well as obstacles at the work site 100. The field of view of each perception sensor 67 is depicted schematically at 68 in FIG. 3.

Figure 3:
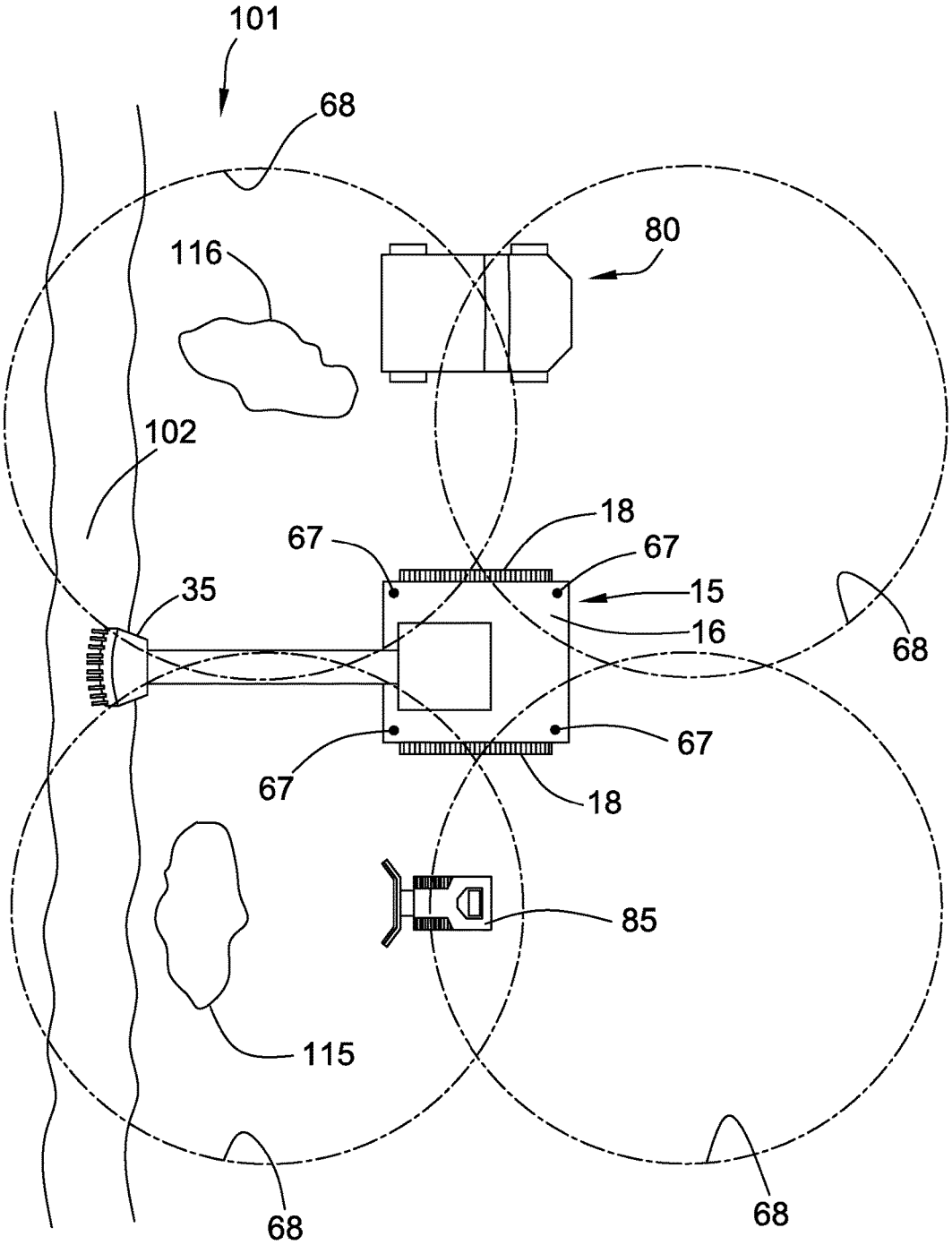
FIG. 3 depicts a schematic view of a portion of the work site of FIG. 1.

Mapping or perception sensors 67 may be mounted on rope shovel 15 such as at four corners of the machine as depicted in FIG. 3. In other examples, perception sensors 67 may be mounted at other locations on the rope shovel 15, on other machines, or mounted in fixed locations at the work site 100. Perception sensors 67 may embody LIDAR (light detection and ranging) devices (e.g., a laser scanner), RADAR (radio detection and ranging) devices, SONAR (sound navigation and ranging) devices, cameras, and/or other types of devices that may determine the range and direction to objects and/or attributes thereof. Perception sensors 67 may be used to sense the range, the direction, the color, and/or other information or attributes about detected objects and the work surface and generate mapping signals indicative of such sensed information and attributes.

The sensed data generated by the perception sensors 67 may be used by the perception system 66 to generate an electronic three-dimensional terrain map of the work site 100. The terrain map may be overlaid or stored as a three-dimensional electronic map of the work site 100 and include the three-dimensional map of the rope shovel 15. In one example, the electronic map may be stored by controller 56 and/or an offboard controller.

The data or data points defining the electronic map of the work site 100 may be generated by the perception system 66 of rope shovel 15, by one or more machines having a perception system, or by a combination of the rope shovel and other machines. Regardless of the manner in which the electronic map is initially generated, data collected by the perception system 66 of the rope shovel 15 and/or other machines having perception systems may be subsequently used to update the electronic map.

The positions of dig locations for the dipper 35 may be set in any desired manner. In one example, the dig locations may be set by an operator manually moving the dipper to a desired location and actuating an input device such as a switch (not shown) within the operator station 20. The signals from the sensors (e.g., swing sensor 62 and crowd sensor 65) indicative of the general position of the desired dig location may be stored by controller 56 to subsequently identify the desired dig location. The process may be repeated for each dig location.

In another example, the desired dig locations may be set or stored by entering the control system 55 into a learning mode and an operator providing instructions to operate the rope shovel 15 to perform a digging operation. Upon performing the digging operation, the controller 56 may determine the swing position from swing sensor 62 and the crowd from crowd sensor 65 and store the positions to subsequently identify the desired dig location. In still another example, the desired dig locations may be set or stored by identifying the locations on the electronic map stored by controller 56. More specifically, an operator may identify or input desired dig locations on a display device within the operator station 20.

Dump locations may be set in a similar manner or through the use of sensors associated with the dipper 35 and/or the haul trucks 80.

Rope shovel 15 may be configured to be operated autonomously, semi-autonomously, or manually. When operating semi-autonomously or manually, rope shovel 15 may be operated by remote control and/or by an operator physically located within the operator station 20. As used herein, a machine operating in an autonomous manner operates automatically based upon information received from various sensors without the need for human operator input. As an example, a haul truck that automatically follows a path from one location to another and dumps a load at an end point may be operating autonomously.

A machine operating semi-autonomously includes an operator, either within the machine or remotely, who performs some tasks or provides some input and other tasks are performed automatically and may be based upon information received from various sensors. As an example, an operator may dump a dipper of rope shovel 15 into haul truck 80 and controller 56 may automatically return the dipper or bucket to a position to perform another digging operation. In another example, the dipper 35 may be moved automatically from the dig location to the dump location. A machine being operated manually is one in which an operator is controlling all or essentially all of the functions of the machine. A machine may be operated remotely by an operator (i.e., remote control) in either a manual or semi-autonomous manner.

Figure 4:
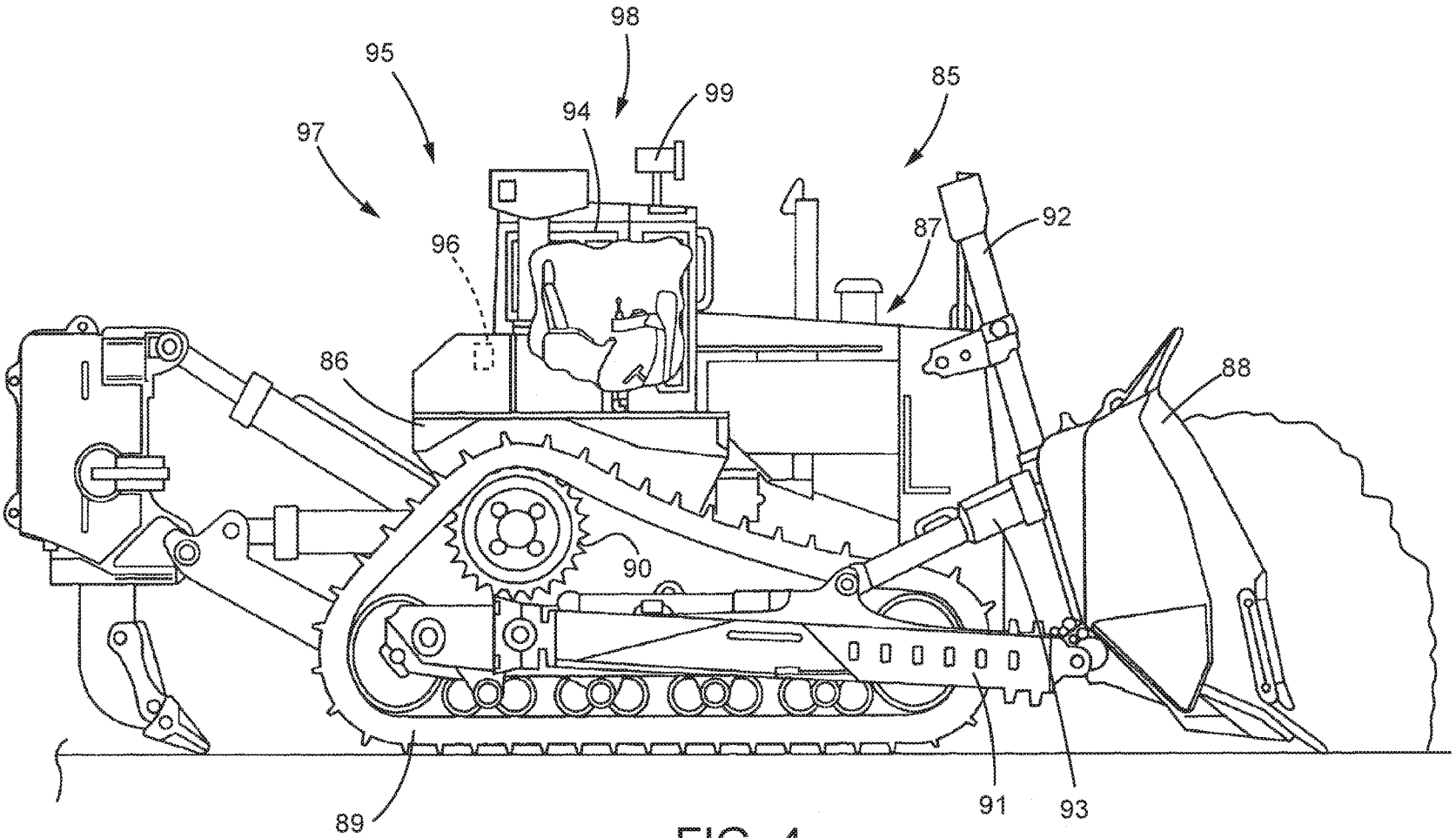
FIG. 4 depicts a diagrammatic illustration of a dozer in accordance with the disclosure.

FIG. 4 depicts a dozer 85 that may operate at work site 100. Dozer 85 has a frame 86, a prime mover such as an engine 87, and a ground engaging work implement such as a blade 88 configured to push material. A ground engaging drive mechanism such as a track 89 may be driven by a drive sprocket 90 on opposite sides of dozer 85 to propel the machine.

Blade 88 may be pivotably connected to frame 86 by arms 91 on each side of dozer 85. First hydraulic cylinder 92 coupled to frame 86 supports blade 88 in the vertical direction and allows the blade to move up or down vertically. Second hydraulic cylinders 93 on each side of dozer 85 allow the pitch angle of the blade tip to change relative to a centerline of the machine.

Dozer 85 may include a cab 94 that an operator may physically occupy and provide input to control the machine. Cab 94 may include one or more input devices such as joysticks, buttons, and levers, etc. through which the operator may issue commands to control the propulsion system and steering system of the machine as well as operate various implements associated with the machine.

As with rope shovel 15, dozer 85 may include an on-board control system 95 and an on-board controller 96 similar to those described above and the descriptions thereof are not repeated. The on-board control system 95 may form a portion of the control system 55 and the on-board controller 96 may form a portion of controller 56.

Dozer 85 may include various systems and sensors for efficient operation of the machine such as a pose sensing system 97 generally similar to that of rope shovel 15 and a perception system generally indicated at 98 including one or more perception sensors 99. The perception system 98 and perception sensors 99 may be generally similar to those of the rope shovel 15 and may provide data indicative of the terrain adjacent the dozer 85.

Control system 55 may include a module or planning system, indicated generally at 70 in FIG. 2, for determining or planning various aspects of a material moving operation. The planning system 70 may utilize various types of inputs from the sensors associated with the rope shovel 15 as well as the electronic map of the work site 100 including the configuration of the work surface, the position of the rope shovel, the position and movement of any obstacles adjacent the rope shovel, desired or proposed dig location(s), desired or proposed dump locations(s), and the characteristics of the material to be moved. Capabilities and desired operating characteristics of the rope shovel 15 as well as its kinematic model may also be stored by controller 56 and used by the planning system 70. The planning system 70 may simulate and evaluate any aspect of a material moving operation, such as by evaluating a plurality of potential paths between the current location of the dipper 35 and a target zone, and then select (or provide feedback regarding) a proposed dig location, dump location, and/or the path between the dig location and the dump location that creates the most desirable results based upon one or more criteria.

The planning system 70 may be utilized regardless of whether the rope shovel 15 is being operated autonomously, semi-autonomously, or manually. When operating the rope shovel 15 manually, the planning system 70 may provide suggestions for dig locations, dump locations, and paths therebetween. When operating autonomously or semi-autonomously, the planning system 70 may determine, and the controller 56 may generate, commands to direct the dipper 35 to the desired location or in a desired manner such as by controlling the rotation of the base 16 relative to the crawler 17, the movement of the dipper handle 40 relative to the boom 25, and/or the height of the dipper 35. Such commands may control any of the speed and acceleration (and deceleration) of each type of movement of the rope shovel 15 (i.e., rotation, crowd, and hoist).

During material moving operations performed by rope shovel 15, material may be displaced onto ground surface 104, which may reduce the efficiency of the material moving operations. For example, material may be displaced from the face 102 or other locations, resulting in a pile of material 115 (FIG. 3) located adjacent the toe of the area being excavated. In another example, material may be spilled during a material loading or carrying process, such as when loading a haul truck 80, resulting in a pile of material 116 located adjacent a dump location. Although depicted at the toe of the face 102 and at a dump location, undesired material may be located at any location in the vicinity (e.g., adjacent or within the range of operation of the dipper 35) of rope shovel 15.

The undesired material 115, 116 may be identified in a plurality of manners. In one example, the material 115, 116 may be identified by perception system 66 and stored in the electronic map by controller 56. Upon the undesired material 115, 116 reaching a predetermined threshold, such a specified size or height, a material movement or clean-up request may be generated by controller 56. In another example, a material movement or clean-up request may be generated by an operator of rope shovel 15. The location of the undesired material 115, 116 may be specified, for example, by the operator pressing a visual display (not shown) within the operator station 20 or by actuating an input device (not shown) when the dipper 35 is near the undesired material.

In still another example, a location of undesired material may be designated based upon operation of the rope shovel 15 through a predetermined number of material movement cycles. In such case, the number of material movement cycles may be based upon a number of factors including the distance traveled during each cycle and the material characteristics of material being moved by the dipper 35.

Figure 5:
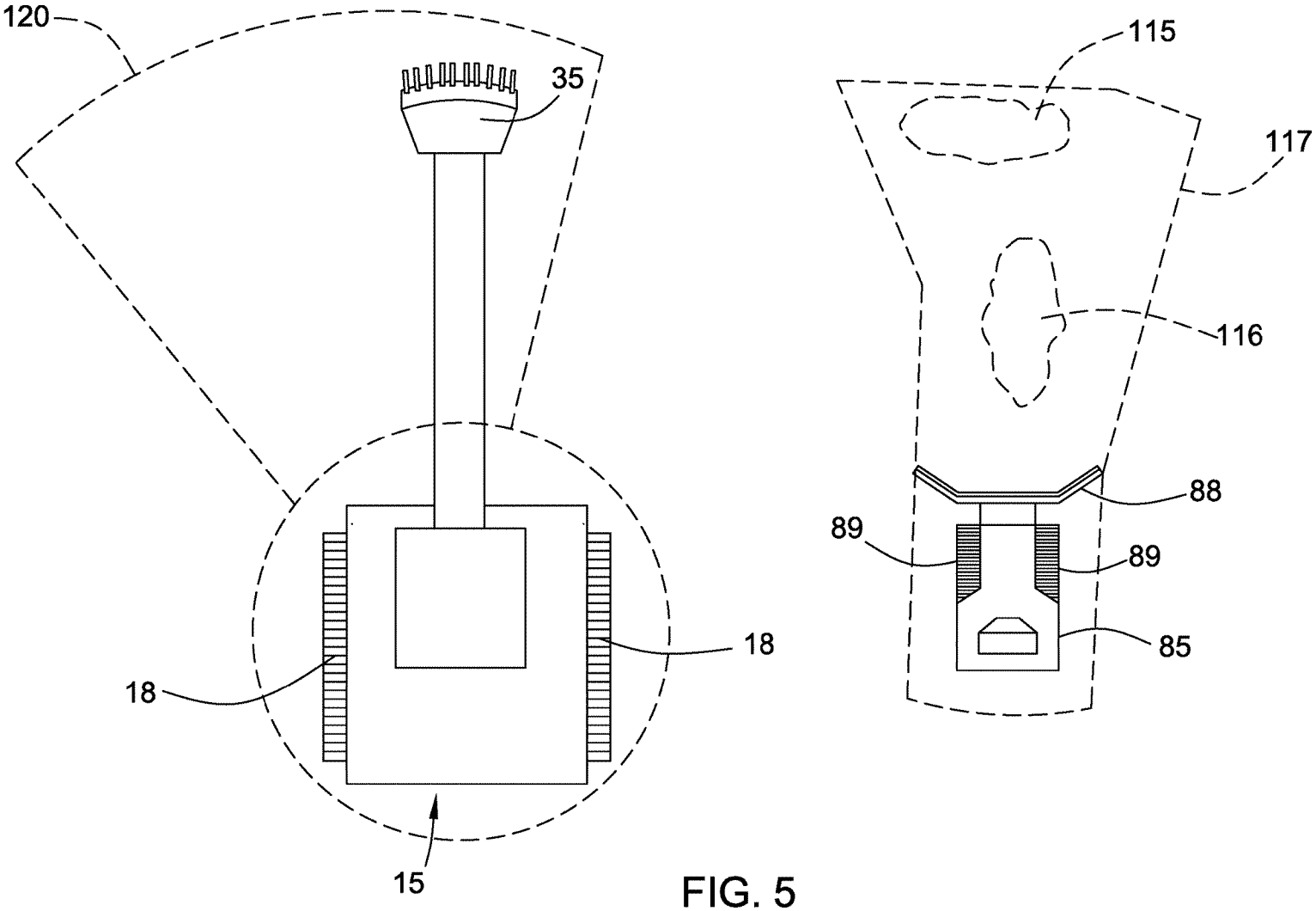
FIG. 5 depicts a schematic view of the operational zones of a rope shovel and an adjacent dozer.

Upon generating a material movement request, an avoidance zone or machine operation zone 117 (FIG. 5) may be generated by controller 56 signifying or corresponding to a zone in which a material moving machine such as dozer 85 may be operating to remove the undesired material. It should be noted that machine operation zone 117 is depicted in FIG. 5 with both undesired material 115 and undesired material 116 for purposes of illustration and both types of material may not be present in the machine operation zone.

The machine operation zone 117 may include the area generally surrounding the material 115, 116 and further include the current location of the machine and the path between the current location of the machine and the pile of material. In addition, if the materials 115, 116 is being moved to another location, the machine operation zone 117 may further include the other location as well as the path to the other location. Accordingly, it may be understood that the machine operation zone 117 includes not only the current location of the dozer 85, but also the planned or expected positions at which the machine will be located.

In instances in which an operator is operating some aspect of rope shovel 15, either within operator station 20 or remotely, the machine operation zone 117 of the dozer 85 may be displayed on a visual display at the operator station or remote site to assist the operator.

If the controller 56 is operating some aspect of the rope shovel 15, the planning system 70 may use the machine operation zone 117 of the dozer 85 to revise or modify the path that the dipper 35 of rope shovel 15 travels between a dig location and dump location. In doing so, the planning system 70 may modify one or both of the dig location and dump location.

Figure 6:
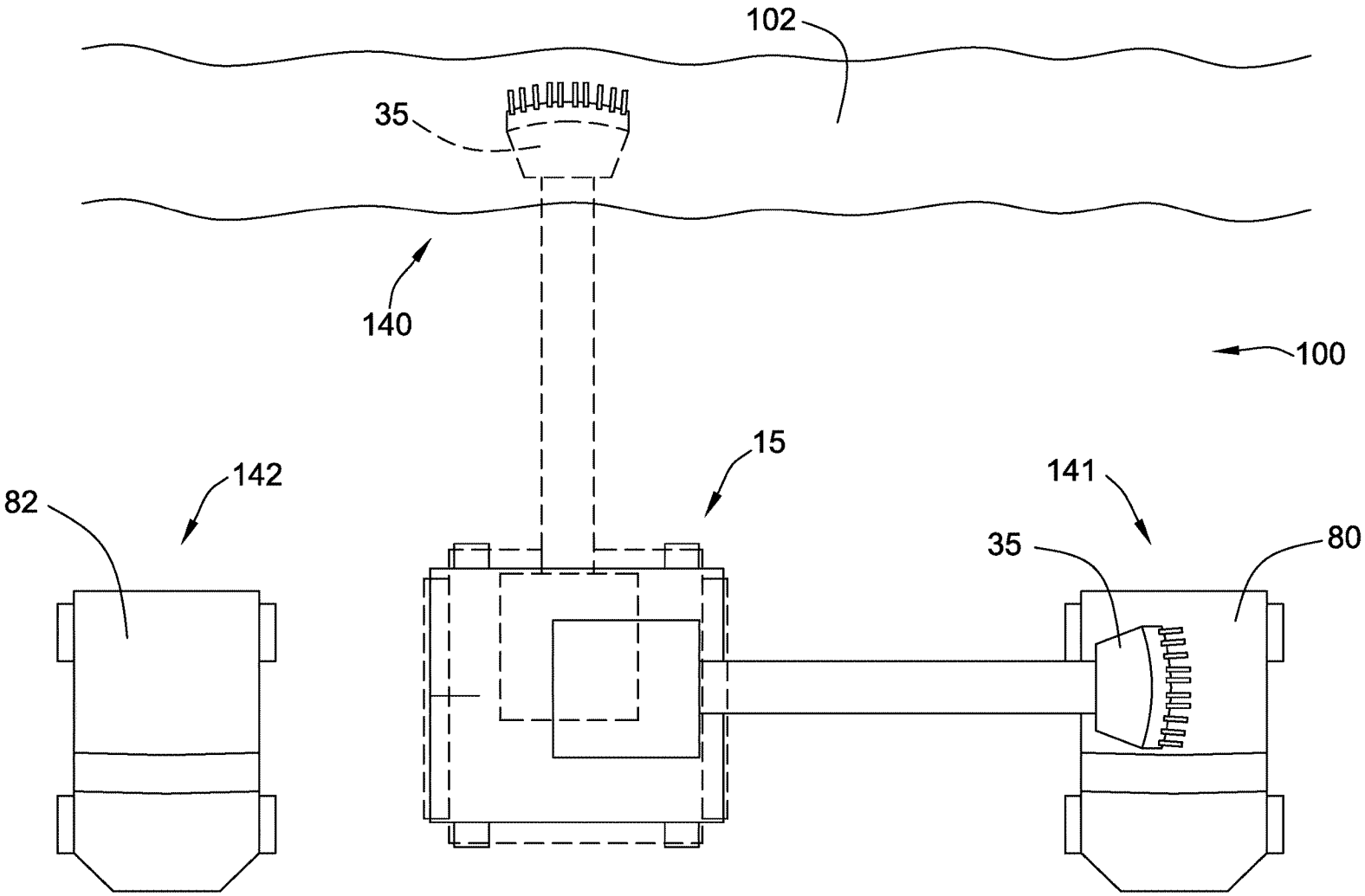
FIG. 6 depicts a schematic view similar to FIG. 3 but utilizing a second haul truck.

For example, referring to FIG. 6, a material moving operation is depicted in which the dump location is modified in view of a requested material movement operation. As rope shovel 15 operates at a dig location 140 and a first loading or dump location 141, material may be inadvertently dumped at the first dump location. Upon generating a material movement request, a second loading or dump location 142 may be generated or stored specifying a new location at which haul trucks 80 may be loaded. The first dump location 141 and the second dump location 142 may be positioned at any location but are depicted in FIG. 6 on opposite sides of the rope shovel 15.

During a material loading operation, material may be loaded into the dipper 35 at the dig location 140 and the dipper moved into alignment with a first haul truck 80 located at the first dump location 141 and unloaded. Upon emptying the dipper 35, the controller 56 may generate a plurality of command signals to move the dipper back to the dig location 140 and the process of loading the first haul truck 80 may be repeated until the first haul truck is fully loaded. While the dipper 35 is being moved back to the dig location 140, a subsequent haul truck 80 may be positioned at the first dump location and the material movement process continued.

Upon the generation of a material movement request for a location adjacent the first dump location 141, a second haul truck 82 may be positioned at the second location 142 and the controller 56 may modify the material movement plan so that material is dumped at the second dump location rather than the first dump location. In some instances, the modification of the dump location may occur after the haul truck 80 at the first dump location 141 has been completely filled. The material movement operation may continue with material being dumped at the second dump location 142 until the first dump location 141 has been cleared of undesired material, the second dump location has been reshaped as desired, the second haul truck 82 at the second dump location has been filled, a material movement request has been generated for the second dump location, or for any other desired period.

Figure 7:
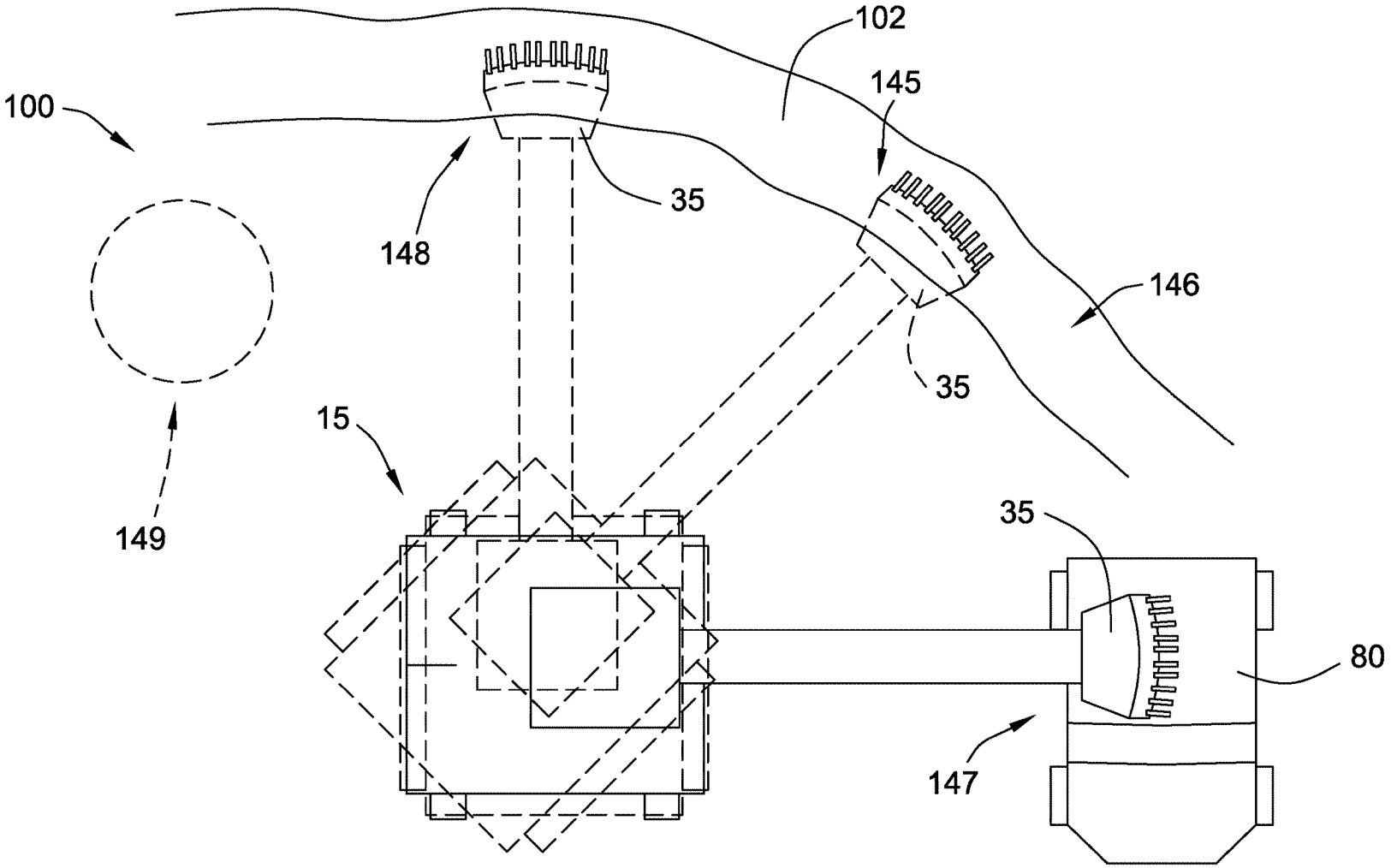
FIG. 7 depicts a schematic view similar to FIG. 3 but utilizing a second dig location.

In a second example depicted in FIG. 7, a material moving operation is depicted in which the dig location is modified in view of a requested material movement operation. As rope shovel 15 digs at a first dig location 145 and dumps at dump location 147, material may build up or fall adjacent the toe of face 102 which may adversely affect the material moving process. Upon generating a material movement request near the first dig location 145, a second dig location 146 may be generated or stored specifying a new dig location.

More specifically, during a material loading operation, material may be loaded into the dipper 35 at the first dig location 145 and the dipper moved into alignment with a haul truck 80 located at the dump location 147 and unloaded. Upon emptying the dipper 35, the controller 56 may generate a plurality of command signals to move the dipper back to the first dig location 145 and the process of loading the haul truck 80 may be repeated until the haul truck is fully loaded. Once the haul truck 80 is fully loaded, the haul truck may depart the dump location 147 and an empty haul truck positioned at the dump location.

If material builds up or falls adjacent the first dig location 145, a material movement request may be generated. The planning system 70 may modify the material movement plans or generate new plans to utilize the new or second dig location 146 and avoid the machine operation zone 117 (FIG. 5) at which the dozer 85 may be operating to perform the material movement operation. In some instances, the second dig location 146 may be closer to the dump location 147. In other instances, the second dig location 148 may be on an opposite side of the first dig location 145 and a new, second dump location, indicated at 149, may be utilized.

Regardless of the manner of operation of the rope shovel 15 (autonomous, semi-autonomous, or manual), in some embodiments, the controller 56 may prevent components of the rope shovel 15 from entering the machine operation zone 117 of the dozer 85. In other instances, an alert may be generated if the rope shovel 15 begins to enter the machine operation zone 117 of the dozer 85.

Dozer 85 may be configured to perform material movement operations autonomously, semi-autonomously, or manually. In instances, in which planning system 70 is identifying desired paths for components of the rope shovel 15 and an operator is operating the dozer 85, either within cab 94 or remotely, a machine operation zone 120 of the rope shovel 15 may be communicated to and displayed on a visual display at the cab or remote site to assist the operator of the dozer. As with the machine operation zone 117 of dozer 85, the machine operation zone 120 of rope shovel 15 includes not only the current position of the machine but also the expected positions at which the rope shovel will be located.

The planning system 70 may generate desired paths and movement commands when the rope shovel 15 is being operated autonomously or semi-autonomously and thus the displayed machine operation zone 120 will match the operation of the rope shovel. However, in instances of manual operation of the rope shovel 15, the planning system 70 may only generate desired or suggested paths that the operator may or may not follow. In such case, the machine operation zone may be displayed in a different manner (e.g., a different color) if the rope shovel is being operated manually to indicate to the dozer operator that the rope shovel may deviate from the suggested path.

As with the rope shovel 15, regardless of the manner of operation of the dozer 85, in some embodiments, the controller 56 may prevent components of the dozer from entering the machine operation zone 120 of the rope shovel. In other instances, an alert may be generated if the dozer 85 begins to enter the machine operation zone 120 of the rope shovel 15.

To the extent that either the rope shovel 15 or the dozer 85 includes some aspect of manual operation, the controller 56 may share the machine operation zone of the other machine. More specifically, the machine operation zone 117 of the dozer may be shared with the rope shovel 15 and displayed within operator station 20 and the machine operation zone 120 of the rope shovel may be shared with the dozer and displayed within cab 94. The controller 56 may also use the operation zones of each machine to control the operation of either or both the rope shovel 15 and the dozer 85 as necessary to prevent or limit movement of one machine into the operation zone of the other machine.

INDUSTRIAL APPLICABILITY

The industrial applicability of the systems described herein will be readily appreciated from the foregoing discussion. The present disclosure is applicable to many machines and tasks performed by machines. Exemplary machines include rope shovels, hydraulic mining shovels, and excavators.

When machines operate in proximity to each other, there is a risk of a collision between machines. Systems have been developed to prevent or reduce the likelihood of collisions such as by creating avoidance zones surrounding the machines. However, such systems may reduce the efficiency of the machine operation by preventing all operations within a specified range surrounding each machine. In some instances, it may be desirable to permit operation adjacent a portion of a machine while identifying the proximity between the machines and, in some instances, prevent conflicting movement.

In addition, it may be difficult or impossible to quickly stop the movement of certain large machines. Accordingly, it may be desirable to predict potential paths or zones of operation and utilize such zones of operation as avoidance zones to reduce or eliminate the need to rapidly stop a machine.

Figure 8:
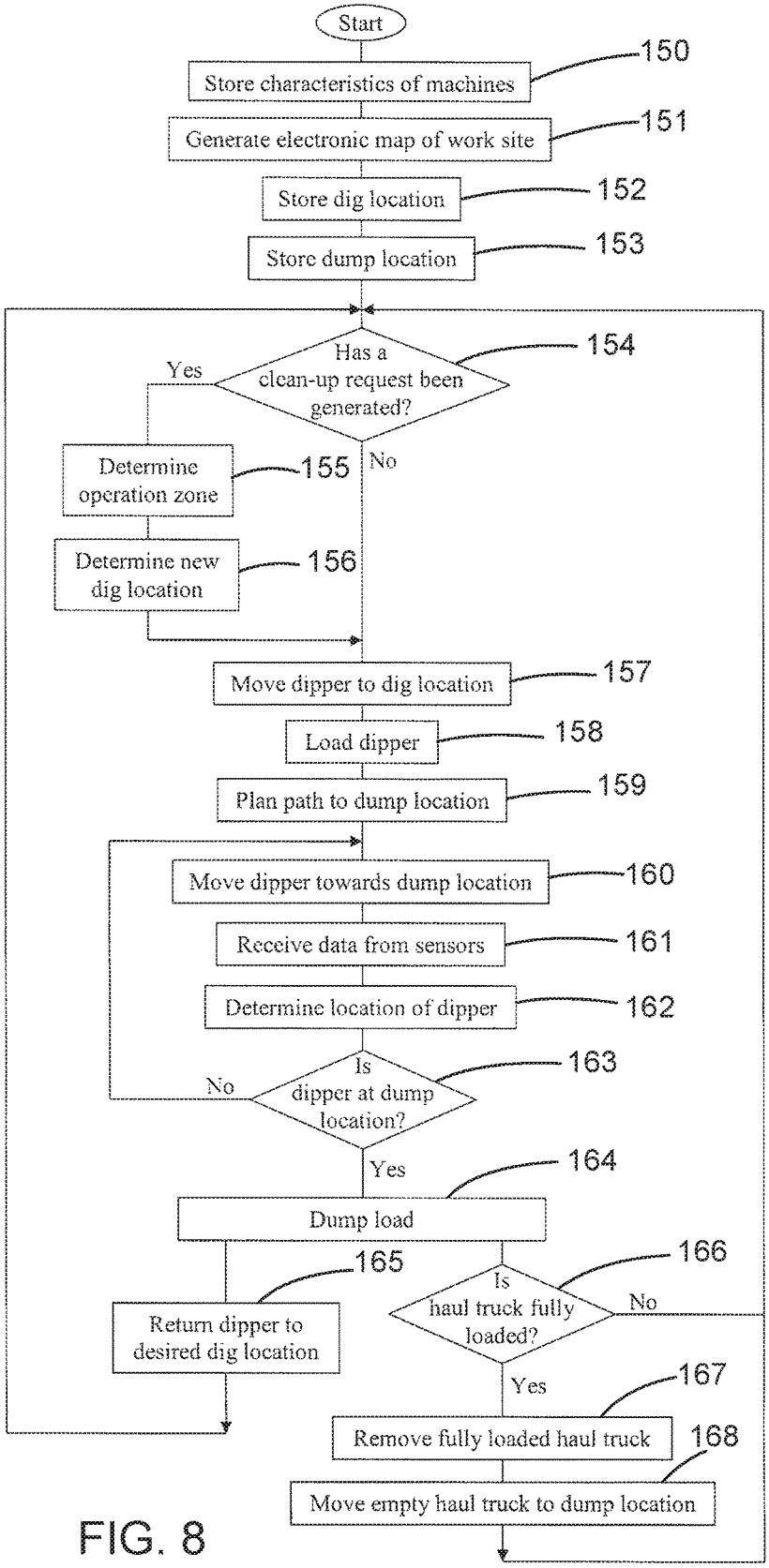
FIG. 8 depicts a flowchart illustrating a material moving process in accordance with the disclosure.

Referring to FIG. 8, a flowchart of a semi-autonomous material moving operation using rope shovel 15 is depicted. The flowchart depicts a process in which a rope shovel operator may manually perform a digging operation and the controller 56 semi-autonomously moves the dipper 35 into alignment with a haul truck 80, dumps the load from the dipper, and returns the dipper to a dig location at which the rope shovel operator may perform a new digging operation. The process depicted by the flowchart includes the possibility of a material movement operation adjacent the dig location. As described above, the material moving process may also include clean-up operations at other locations such as adjacent a dump location.

At stage 150, characteristics of the machines operating at the work site 100 may be entered into controller 56. The characteristics may include operating capacities, dimensions, desired operating characteristics, and other desired or necessary information. Examples may include the kinematic model of the rope shovel 15 and the dimensions of the haul trucks 80 and dozers 85.

An electronic map of the work site 100 may be generated at stage 151. In one example, the electronic map may be created by the perception system 66. The perception sensors 67 may generate mapping signals that are received by controller 56 and the controller may convert the mapping signals into an electronic map of the work site 100. The electronic map may include representations that depict the positions of face 102, ground surface 104, and the rope shovel 15.

One or more dig locations may be set or stored at stage 152 by controller 56. The dig locations may be identified and stored by controller 56 in any desired manner. In one example, an operator may move the dipper 35 to a desired dig location and actuate an input device such as a switch (not shown) within the operator station 20. Signals from the sensors (e.g., swing sensor 62, hoist sensor 63, and crowd sensor 65) indicative of the position of the desired dig location may be stored by controller 56.

At stage 153, one or more dump locations may be set or stored by controller 56. The dump locations may be identified and stored by controller 56 in any desired manner. In one example, an operator may move the dipper 35 to a desired dump location and actuate an input device such as a switch (not shown) within the operator station 20 to dump the material from the dipper. Signals from the sensors (e.g., swing sensor 62, hoist sensor 63, and crowd sensor 65) indicative of the position of the desired dump location may be stored by controller 56. In other instances, the dump locations may be set or stored based upon information from the perception system 66, a pose sensing system of a haul truck 80, and/or any other desired systems.

The path of the dipper 35 may be set or determined by planning system 70 to move the dipper from its initial location to the dig location. In doing so, the planning system 70 may determine at decision stage 154 whether a material movement request has been generated. If a claim-up request has been generated, the planning system 70 may determine at stage 155 the avoidance zone or machine operation zone 117 associated with the undesired material. The machine operation zone may be based upon the position and amount of undesired material, the current pose of the dozer 85 as well as the location to which the undesired material may be moved. At stage 156, the planning system 70 may determine a new dig location based upon the machine operation zone 117. It should be noted that it may be unlikely that a material movement command will be generated at the beginning of a material moving operation.

If a material movement request is not been generated at decision stage 154 or upon completing stage 156, the controller 56 may generate a plurality of command signals to move dipper 35 to the current or most recently set dig location at stage 157. At stage 158, dig command signals may be generated causing the dipper 35 to loaded with material such as from the face 102 of the mine 101 (FIG. 1). It should be noted that the step of setting or storing the dig location at stage 152 may occur based upon stages 157 and/or 158 depending upon the manner in which the dig location(s) are stored. The planning system 70 may plan at stage 159 a desired path to the dump location. More specifically, the planning system 70 may determine the desired path for the dipper 35 to follow to the haul truck 80. Upon loading the dipper 35, the planning system 70 may determine the desired path from the dig location to the dump location.

The controller 56 may generate at stage 160 command signals to move the dipper 35 along the identified or predetermined path towards the haul truck 80. At stage 161, controller 56 may receive data from the various sensors of the rope shovel 15 and haul truck 80 and use such data at stage 162 to determine the position of the dipper 35. The controller 56 may determine at decision stage 163 whether the dipper 35 is sufficiently aligned with the dump location. If the dipper 35 is not sufficiently aligned with the dump location, the dipper 35 may continue to be moved towards the desired position and stages 160-163 repeated.

If the dipper 35 is aligned with the dump location, dump command signals may be generated so that the load within the dipper 35 is dumped into haul truck 80 at stage 164. To do so, the controller 56 may generate a command to actuate the door actuator motor 49 that engages actuator cable 48 to open the door 37.

While the dipper 35 is being returned to the desired dig location at stage 165, the controller 56 may determine at decision stage 166 whether the haul truck 80 is fully loaded. In one embodiment, a load sensing system of haul truck 80 may be used to determine when the haul truck is fully loaded. If the haul truck 80 is not fully loaded, the haul truck may remain in place and the material moving process may be continued and stages 154-166 repeated.

If the haul truck 80 is fully loaded, the haul truck may be moved at stage 167 from the dump location and transported to a desired location spaced from the dump location. Once the fully loaded haul truck 80 has been moved from the dump location, an empty haul truck may be moved at stage 168 to the dump location and the material moving process may be continued and stages 154-168 repeated.

In instances in which a material movement request has been generated, the dozer 85 may operate within the machine operation zone 117 while the rope shovel 15 is moving material as depicted by the flowchart of FIG. 8.

Various alternative processes are contemplated. For example, in some instances, it may be desirable to generate a new dump location upon generating a new dig location. Such new dump location may be used while using the new dig location and may continue to be used after the material movement process has been completed. In addition, although described in the context of undesired material being located adjacent the dig location, the planning system 70 may also compensate for material movement requests at other locations such as at dump locations as well as locations between a dig location and a dump location. In instances in which undesired material is located adjacent a dump location, a new dump location may be determined or set by the planning system 70. In some instances, it may be desirable to generate a new dig location upon generating the new dump location. Such new dig location may be used while using the new dump location and may continue to be used after the material movement process has been completed.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for controlling operation of a first material engaging work implement comprising:

a first machine including:

a first ground engaging drive mechanism to propel the first machine;

a base mounted on the first ground engaging drive mechanism, the base including an implement system having a linkage assembly with a boom and the first material engaging work implement, the base being rotatable relative to the first ground engaging drive mechanism;

a first machine pose sensor for generating first machine pose signals indicative of a pose of the first machine;

a second machine including:

a second ground engaging drive mechanism to propel the second machine;

a second material engaging work implement; and a controller configured to:

store a kinematic model and characteristics of the implement system of the first machine;

determine a second machine operation zone, the second machine operation zone being defined by a material movement plan of the second machine and including a current location and planned locations of the second machine;

determine a current pose of the first machine based upon the first machine pose signals, the current pose of the first machine and the kinematic model and characteristics of the implement system of the first machine defining a range of operation of the first material engaging work implement of the first machine;

while the second machine operation zone is within the range of operation of the first material engaging work implement of the first machine, determine a first machine operation zone of the first material engaging work implement based upon the current pose of the first machine, the kinematic model and characteristics of the implement system, and the second machine operation zone, the first machine operation zone being within the range of operation and spaced from the second machine operation zone; and generate a plurality of command signals to move the first material engaging work implement within the first machine operation zone between a first position and a second position while avoiding passing through the second machine operating zone.

2. The system of claim 1, wherein the first position is a dig location and the second position is a dump location.

3. The system of claim 2, wherein the controller is further configured to:

store a first dig location, the first dig location corresponding to the dig location and being within the second machine operation zone;

generate first dig command signals to move the first material engaging work implement from the first dig location to the dump location;

generate dump command signals to dump a load of material carried by the first material engaging work implement at the dump location; and generate command signals to move the first material engaging work implement from the dump location to a second dig location.

4. The system of claim 2, wherein the controller is further configured to:

store a first dump location, the first dump location corresponding to the dump location and being within the second machine operation zone;

generate dig command signals to move the first material engaging work implement from the dig location to the first dump location;

generate dump command signals to dump a load of material carried by the first material engaging work implement at the first dump location; and generate command signals to move the first material engaging work implement from the dump location to a second dig location.

5. The system of claim 1, wherein the material movement plan of the second machine is based upon input from an operator of the first machine.

6. The system of claim 5, wherein the controller is configured to operate in a learning mode and receive instructions from an operator during a material movement operation.

7. The system of claim 1, wherein the material movement plan of the second machine is based upon input from a perception system.

8. The system of claim 7, wherein the perception system is mounted on the first machine.

9. The system of claim 1, wherein the material movement plan of the second machine is based upon a material movement plan of the first machine.

10. The system of claim 9, wherein the material movement plan of the second machine is based upon operation of the first machine through a predetermined number of material movement cycles.

11. The system of claim 9, wherein the material movement plan of the second machine is further based upon material characteristics of material being moved by the first machine.

12. The system of claim 1, wherein the controller is further configured to autonomously generate the material movement plan of the second machine and communicate the material movement plan of the second machine to the second machine.

13. The system of claim 1, wherein the second machine further includes a second machine pose sensor for generating second machine pose signals indicative of a current pose of the second machine, and the second machine operation zone being further defined by a current pose of the second machine.

14. A method of controlling operation of a first material engaging work implement comprising:

providing a first machine including a first ground engaging drive mechanism to propel the first machine, a base mounted on the first ground engaging drive mechanism, the base including an implement system having a linkage assembly with a boom and the first material engaging work implement, the base being rotatable relative to the first ground engaging drive mechanism;

providing a second machine including a second ground engaging drive mechanism to propel the second machine and a second material engaging work implement;

storing a kinematic model and characteristics of the implement system of the first machine;

determining a second machine operation zone, the second machine operation zone being defined by a material movement plan of the second machine and including a current location and planned locations of the second machine;

determining a current pose of the first machine based upon first machine pose signals generated by a first machine pose sensor, the current pose of the first machine and the kinematic model and characteristics of the implement system of the first machine defining a range of operation of the first material engaging work implement of the first machine;

while the second machine operation zone is within the range of operation of the first material engaging work implement of the first machine, determining a first machine operation zone of the first material engaging work implement based upon the current pose of the first machine, the kinematic model and characteristics of the implement system, and the second machine operation zone, the first machine operation zone being within the range of operation and spaced from the second machine operation zone; and generating a plurality of command signals to move the first material engaging work implement within the first machine operation zone between a first position and a second position while avoiding passing through the second machine operating zone.

15. The method of claim 14, wherein the first position is a dig location and the second position is a dump location.

16. The method of claim 15, further including determining a current pose of the second machine based upon second machine pose signals generated by a second machine pose sensor and defining the second machine operation zone based upon the current pose of the second machine.

17. A machine for use with a second machine, the second machine including a second ground engaging drive mechanism to propel the second machine, a second material engaging work implement, and a second machine operation zone defined by a material movement plan of the second machine and including a current location and planned locations of the second machine, the machine comprising:

a first ground engaging drive mechanism to propel the first machine;

a base mounted on the first ground engaging drive mechanism, the base including an implement system having a linkage assembly with a boom and a material engaging work implement, the base being rotatable relative to the first ground engaging drive mechanism;

a machine pose sensor for generating machine pose signals indicative of a pose of the machine; and a controller configured to:

store a kinematic model and characteristics of the implement system of the first machine;

determine a current pose of the machine based upon the machine pose signals, the current pose of the first machine and the kinematic model and characteristics of the implement system of the first machine defining a range of operation of the first material engaging work implement of the first machine;

while the second machine operation zone is within the range of operation of the first material engaging work implement of the first machine, determine a machine operation zone of the material engaging work implement based upon the current pose of the machine, the kinematic model and characteristics of the implement system, and the second machine operation zone, the machine operation zone being within the range of operation and spaced from the second machine operation zone; and generate a plurality of command signals to move the material engaging work implement within the machine operation zone between a dig location and a dump location while avoiding passing through the second machine operating zone.

* * * * *